United States Patent [19]

Beal

[11] 4,319,529

[45] Mar. 16, 1982

[54] EXPENDABLE PALLET

[76] Inventor: Ira W. Beal, P108 Lake Bloomington, RR#1, Hudson, Ill. 61748

[21] Appl. No.: 118,586

[22] Filed: Feb. 4, 1980

[51] Int. Cl.[3] ..... B65D 19/34

[52] U.S. Cl. ..... 108/51.3; 108/56.1; 206/600

[58] Field of Search ..... 108/53.1, 56.1, 56.3; 206/599, 600

[56] References Cited

U.S. PATENT DOCUMENTS

| | | | |
|---|---|---|---|
| 2,698,696 | 1/1955 | Strong | 108/51.3 X |
| 3,043,450 | 7/1962 | Caprin et al. | 108/51.3 X |
| 3,242,884 | 3/1966 | Best et al. | 108/51.3 |
| 3,946,883 | 3/1976 | Beal | 108/51.3 X |
| 3,964,618 | 6/1976 | Dreyer | 108/51.3 X |

*Primary Examiner*—William E. Lyddane

*Attorney, Agent, or Firm*—Kinney and Schenk

[57] ABSTRACT

An expendable pallet is formed from a blank to define at least one trough area for receiving items of material for storing thereon and transporting same. A double thickness wing provides greater stability in the lifting force application area.

5 Claims, 3 Drawing Figures

EXPENDABLE PALLET

TECHNICAL FIELD

This invention relates generally to material handling devices and more particularly to an expendable pallet for pallatizing material.

BACKGROUND ART

Pallatizing material for shipping and storage of various material is well known. Pallet construction has primarily been of a firm, rigid construction material such as wood or metal. Such pallets are often expensive and present the problem of returning the pallets to the shipper.

Expendable pallets of paperboard decrease the problem of returning the pallets. The cost of such pallets is substantially less than the rigid construction pallets. My prior expendable pallet disclosed in U.S. Pat. Nos. 3,946,883 and 4,009,787 have been especially useful with deformable bags of flowable material.

Although deemed expendable, it is desirous to use such pallets more than one time. This use is often limited because the edges of the pallet become damaged during use.

A disadvantage of my prior pallet was that a supporting frame was often needed to provide added structural support. Even though an interlocking flap was provided, the wings would, on occasion, sag or pivot downward about the score line.

The present invention is directed to overcoming one or more of the problems set forth above.

DISCLOSURE OF THE INVENTION

In one aspect of the present invention, an expendable pallet comprises at least one material receiving trough and wings extending therefrom, wherein the wings are double thickness for added strength and support. The wings form the surface which accept the lifting prongs of a fork lift.

In another aspect of the present invention, a pallet blank is scored so as to define at least one material receiving trough. Double thickness wings extend outward from the trough and the double thickness also extends inwardly in the trough base. An inner channel may be formed in the blank to form more than one material receiving trough and to receive a third lifting element.

This invention solves the problem of how to extend the use life of expendable pallets. The damage to the edges of the wings is substantially reduced because of the double thickness. The double thickness of the wings prevent sagging of the wings when the material, bags or the like, have been placed in the trough.

BEST MODE FOR CARRYING OUT THE INVENTION

Figure 1:
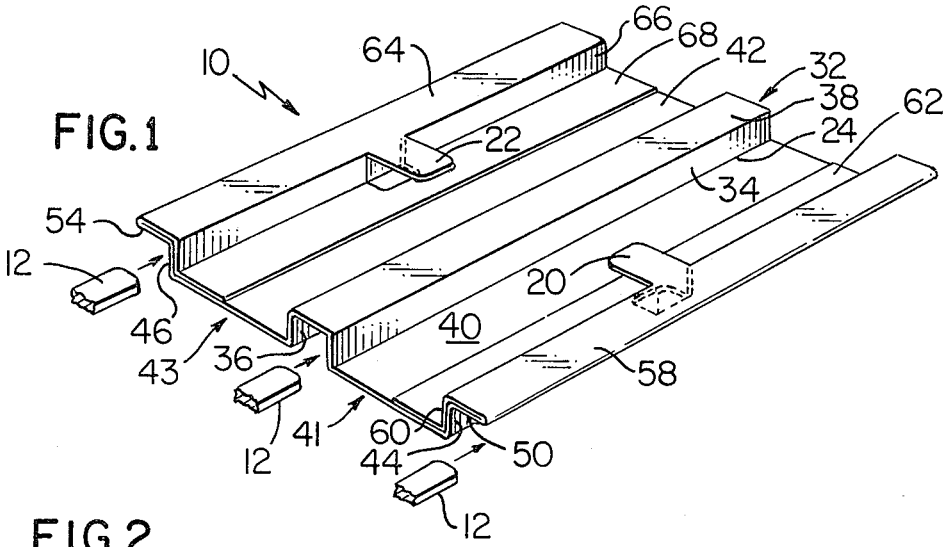
FIG. 1 is a perspective view of an expendable pallet, made in accordance with this invention, showing the forward ends or prongs of a fork truck in position to enter the pallet.

Referring now to FIG. 1 of the drawings, an expendable pallet 10 is shown formed in accordance with this invention. The pallet 10 is formed to receive the prongs 12 of a fork lift truck (not shown). The pallet 10 will receive and support multiple items of material in stacked fashion such as shown in phantom lines in FIG. 3. The material may be solid, such as bricks and concrete blocks, boxes, or flexible bags of flowable material, i.e. seeds, sugar, cement and the like.

Figure 2:
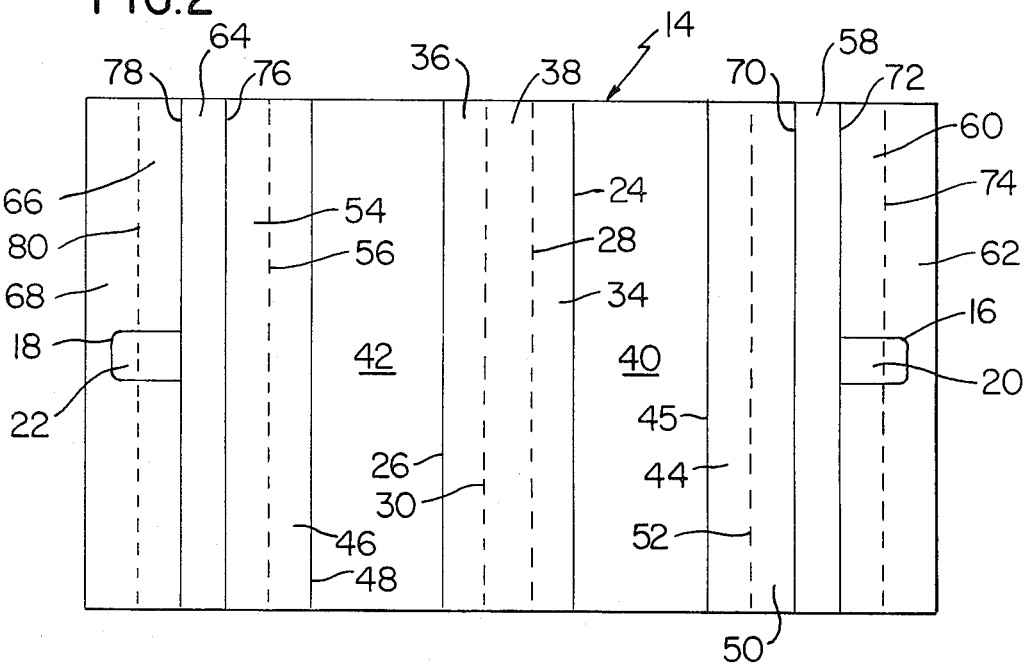
FIG. 2 is a plan view of the blank used to form the pallet of FIG. 1.

The pallet 10 is formed from a blank 14 shown in plan view in FIG. 2. The blank 14 is cut from any foldable materal such as cardboard, paperboard, corrugated paperboard and the like. If the material is treated by known processes, it becomes water resistant and has added utility for outdoor use or in areas where moisture may be present. The blank is formed with score lines and reverse score lines, to be described herein below, and cut lines 16 and 18 which form flaps 20 and 22.

Blank 14 is formed with score lines 24 and 26 and reverse score lines 28 and 30. When folded a channel shown generally as 32 (FIG. 1) is formed. The channel 32 receives one of the prongs 12 of the lift truck (not shown). It is seen that the channel 32 is comprised of vertical walls 34 and 36 and a top portion or wing 38.

Connected to the lower edge of walls 34 and 36 by score lines 24 and 26 respectively are bases 40 and 42. The other edge of each base is respectively connected to vertical walls 44 and 46 by score lines 45 and 48. Outwardly extending wing 50 is connected to the upper edge of wall 44 by reverse score line 52. In the same manner, outwardly extending wing 54 is connected to the upper edge of wall 46 by reverse score line 56.

Walls 34 and 44 and base 40, along with walls 36 and 46 and base 42 define, generally, material receiving troughs 41 and 43 similar to my prior pallets defined in the U.S. patents aforementioned. To form the pallet 10 of this invention, a second or reinforcing wing 58 and 64, wall 60 and 66 and partial base 62 and 68 is provided in blank 14.

Wings 50 and 58 are connected by score line 70. The other edge of wing 58 is connected by score line 72 to wall 60 and the wall 60 is connected to partial base 62 by reverse score line 74. In a like manner, at the other end of blank 14, wing 64 is connected by score lines 76 and 78 to wing 54 and wall 66. Also, wall 66 is connected to partial base 68 by reverse score line 80.

Figure 3:
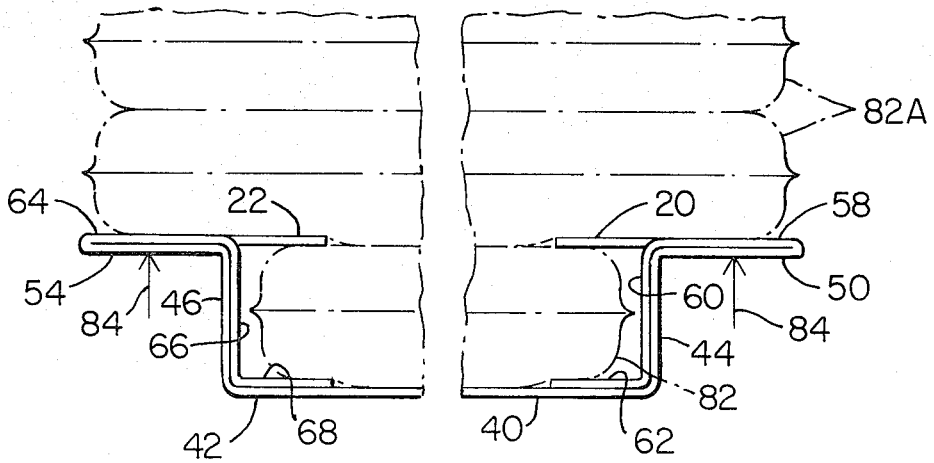
FIG. 3 is an end view of a loaded pallet, partially cut away, the load being shown in phantom lines.

Thus, to finish the forming of pallet 10, the wing 58, wall 60 and partial base 62 are folded to be in abutting relationship with wing 50, wall 60, as well as partial base 62 and base 40. The abutting relationship is best seen in FIG. 3. Wing 64, wall 66 and partial base 68 are folded in a like manner. It is thus seen that the wings, the walls and part of the base of the trough have a second layer or double thickness.

In the formed condition, flaps 20 and 22 each extend in a plane over the respective trough as seen in FIGS. 1 and 3. The flap may or may not be scored depending on the desired length of the flap and the economics of the dies for the scoring of the blank 14. Scoring, or not scoring, of the flap does not affect its operation, as an interlocking means between the pallet 10 and the material supported therein.

As best seen in FIGS. 1 and 3, the pallet 10 is loaded by first placing a layer of the material, bags 82 or the like, within the trough areas 41 and 43. The bags 82 press partial bases 62 and 68 into tight engagement with bases 40 and 42. Flaps 20 and 22, having previously been folded up out of the way, are now brought into position in the plane parallel to the respective base 40 and 42. It is seen that each flap extends a sufficient distance into the trough area to rest upon the layer of bags 82. Additional layers of bags 82A are then loaded upon the pallet. The flaps 20 and 22 thus become locked between two layers of bags.

While FIG. 1 shows central channel 32 so that three prongs 12 may be received, the pallet of this invention will work equally as well with two prong fork lift trucks. In this instance, score lines 24, 26, 28 and 30 are eliminated and no central channel is formed. Thus, as an example as seen in FIG. 3, the pallet is formed with a single material receiving trough.

When loaded, the pallet 10 has added strength and support in the wall and wing area due to the double thickness. The wings will not sag because of the first layer of bags 82 acting against the partial bases 62 and 68 as well as the locking of the flaps 20 and 22 between the layers of bags. Although a single flap is shown with each wing, it is obvious that additional flaps may be cut and used and further that the width of the flap may vary without departing from the scope of this invention.

In operation, the prongs of the lifting mechanism are inserted into the pallet and the lifting force, shown by vertical arrows 84 in FIG. 3, acts through the pallet wings 50 and 54 in the single trough pallet and through wings 50 and 54 and channel top 38 in the double trough pallet. If a lifting mechanism has more than three lifting prongs, it is only necessary to provide additional channels to accept the added prongs.

Other aspects, objects, and advantages of this invention can be obtained from a study of the drawings, the disclosure and the appended claims.

What is claimed is:

1. An expendable pallet comprising:

at least one material receiving trough having a base and a vertical wall at each edge of said base;

wings extending outwardly from the upper portion of each of said walls, said wings being parallel to said trough and defining a lifting force application area external to said trough; and means providing a second layer to said wings and a portion of said trough base to define an inner partial base, said means defining upper and lower wings connected together, said means further defining a second inner vertical wall parallel to each of said vertical walls wherein each inner vertical wall respectively connects each of said upper wings with a corresponding inner partial base.

2. The pallet according to claim 1 including an interlocking flap extending from each respective upper wing in a plane parallel to said base.

3. The pallet according to claim 2 in which said base is formed to define a central channel thereby providing a further lifting force application area, said channel including a pair of vertical walls and a top portion connecting said pair of walls.

4. A blank to form an expendable pallet comprising:

a base;

a vertical wall connected at each outer edge of said base, said base and vertical walls defining a trough area;

a first wing connected at the other end of each of said walls;

a second wing connected at the other end of each of said first wings;

a second vertical wall connected at the other end of each of said second wings;

a partial base connected at the other end of each of said second vertical walls;

said second wing adapted to be folded back over said first wing to provide a double thickness wing, vertical wall and partial base; and said second vertical wall being cut to form an interlocking flap extending from the other edge of each of said second wings when said second wing is folded back over said first wing.

5. The blank according to claim 4 further comprising a pair of vertical walls connected at an inner edge of said base and thereby defining a pair of trough areas, and a top portion connecting said pair of vertical walls to provide a central channel.

* * * * *